US005215187A

United States Patent [19]

Ping-Chieng et al.

[11] Patent Number: 5,215,187

[45] Date of Patent: Jun. 1, 1993

[54] KEYBOARD MEMBRANE KEYSWITCH ASSEMBLY

[75] Inventors: Liao Ping-Chieng, Ban Chiao; Hsu Chien-Shih, Taipei, both of

[73] Assignee: Acer Incorporated, Hsin Chu, Taiwan

[21] Appl. No.: 830,173

[22] Filed: Jan. 31, 1992

[51] Int. Cl.[5] ..... H01H 1/10

[52] U.S. Cl. ..... 200/517; 200/520; 200/345; 200/344

[58] Field of Search ..... 200/517, 520, 521, 341, 200/345, 512, 342, 344, 5 A

[56] References Cited

U.S. PATENT DOCUMENTS

| | | | |
|---|---|---|---|
| 4,440,992 | 4/1984 | Desmarais | 200/340 |
| 4,827,243 | 5/1989 | Cheng | 200/345 X |
| 5,120,923 | 6/1992 | Kato et al. | 200/517 X |

FOREIGN PATENT DOCUMENTS

| | | | |
|---|---|---|---|
| 264125 | 10/1989 | Japan | 200/517 |
| 57114 | 3/1991 | Japan | 200/341 |
| 108218 | 5/1991 | Japan | 200/341 |
| 119620 | 5/1991 | Japan | 200/517 |

*Primary Examiner*—Henry J. Recla
*Assistant Examiner*—Glen T. Barrett
*Attorney, Agent, or Firm*—Kenneth M. Kaslow

[57] ABSTRACT

A keyboard membrane keyswitch assembly comprises a housing, a button, a compression piston and a rubber element. The housing holds the compression piston and the rubber element. The compression piston preferably has a cylindrical shape with a vertical guider along its longitudinal axis. The vertical guider is used to connect the assembly to the button. A supporting ring is linked to the vertical guider by rib elements. The rubber element is adapted to receive the supporting element of the compression piston thereby maximizing the displacement of the button and preventing the button from tilting when it is depressed.

1 Claim, 2 Drawing Sheets

KEYBOARD MEMBRANE KEYSWITCH ASSEMBLY

BACKGROUND OF THE INVENTION

1. Field of the Invention

The present invention relates generally to the field of a keyboard keyswitch assembly, and more particularly to a keyboard membrane keyswitch assembly of the kind comprising a housing, a compressing piston, a button and a rubber element. Said compressing piston comprises at least a pair of suspending guiding arms linked with the compressing piston's main vertical guider located at the central part of said compressing piston by at least a pair of the rib element and a connector. A guiding track on the main vertical guider is provided for the insertion of said connector. The rubber element is placed inside the housing and on top of the membrane switch. Said rubber element has a support member and said connector is placed on top of the support member.

This invention relates to the switch of a notebook computer keyboard. With the advancement of technology, such as the announcement of power saving microprocessor, and the consumer's need, notebook computers become a popular product in the information market. Desktop computers are gradually replaced by the notebook computers.

2. Description of the Prior Art

The membrane keyswitch is designed to provide the operator with a steady inputting mechanism, so that, when a keyswitch is depressed, the keyswitch maintains a steady position and will not tilt to one side. As a result, the keyboard is more convenient to use and minimizes fatigue. The membrane switch of this kind is disclosed in the R.O.C. patent application number 80202928, where other variations of this keyswitch are detailed.

SUMMARY OF THE INVENTION

The membrane keyswitch incorporated in notebook computers are quite different from those commonly used in other types of computers, since the notebook computers are more compact and smaller in size. The prior art usually has the connection of the support member of the rubber element and the compressing piston designed in the central position of the space inside the housing. When the button is depressed, its displacement is limited by the existence of the rubber element. Furthermore, the assembly of this kind has a tendency to tilt when the button is depressed.

The principal function of the invention is to provide a novel keyswitch assembly, in which the displacement of the keyswitch is maximized, even with the existence of the rubber element within the housing of the keyswitch.

The other function of the invention is to provide a keyswitch assembly, in which the button maintains in a steady position and will not tilt to one side, when the keyswitch is depressed.

DETAILED DESCRIPTION OF THE PREFERRED EMBODIMENTS

Figure 1:
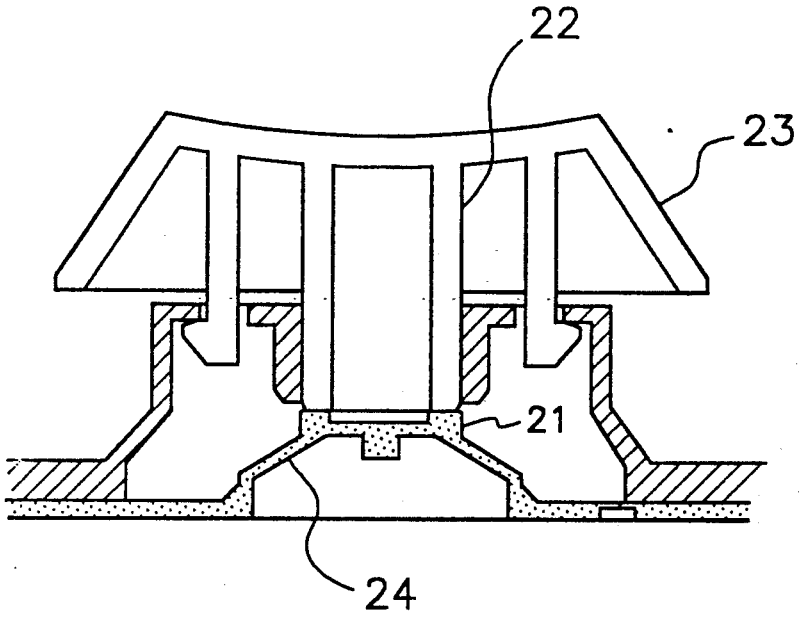
FIG. 1 (PRIOR ART)
FIG. 1 is a side elevation in a cross-section of an entire membrane keyswitch of the prior art, in which the keyswitch is not depressed.
Figure 2:
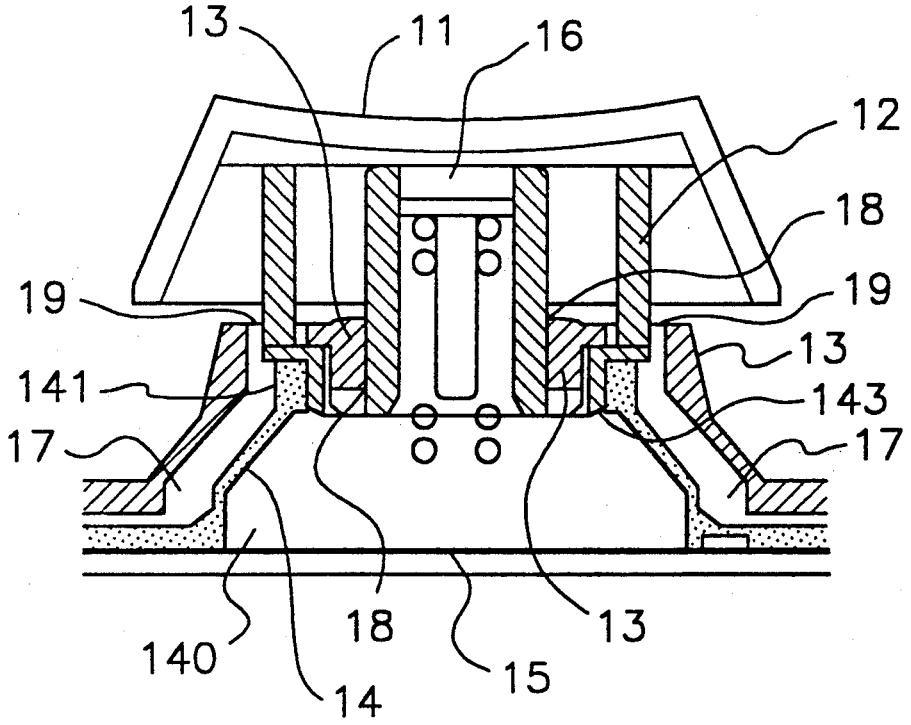
FIG. 2 is a side elevation in a cross-section of an entire membrane keyswitch of the present invention, in which the keyswitch is not depressed.
Figure 3:
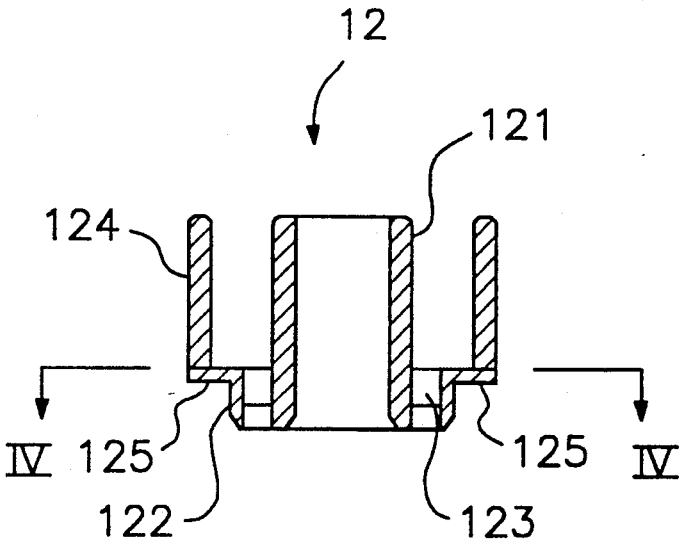
FIG. 3 is a side elevation in a cross-section of the compressing piston.
Figure 4:
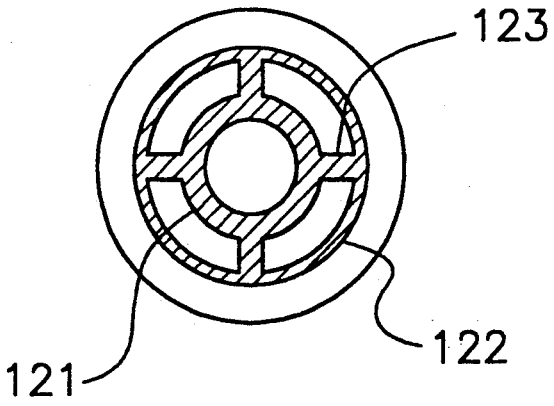
FIG. 4 is a cross section of the compressing piston along IV—IV in FIG. 3.

FIG. 2 shows a membrane keyswitch embodying the present invention. This keyswitch includes a housing 13, a button 11, a compressing piston 12, and a rubber element 14. Said housing 13 has a base opening 17 placed on top of a membrane switch 15, and at approximately the central position of the other end of said housing 13, has a first top opening 18. Second top openings 19 are located on opposite sides of the first top opening 18. About the central position of the internal surface of button 11 there is a connector 16. Referring now to FIG. 3, there is shown a longitudinal section of compressing piston 12 which has a cylindrical shape and comprises a main vertical guider 121 at its center. Vertical guider 121 provides a guiding track for the insertion of the connector 16. Compressing piston 12 has a supporting ring 122 at its base which is shown in cross section in FIG. 4. Supporting ring 122 shares the same axis as that of the main vertical guider 121 and has a lip 125 extending perpendicularly from this axis. Supporting ring 122 links to the main vertical guider 121 by a rib element 123. On lip 125 of the supporting ring 122, parallel to guider 121, there exists at least a pair of the suspending guiding arms 124.

The rubber element 14 is located in the space within the housing 13 and has bottom opening 140 placed on top of the membrane switch 15. A support opening 143 is defined by a support member 141 of the rubber element 14, forms the face opposite base opening 140 and is provided for supporting the connecting ring 122.

The assembly of this keyswitch requires installation of the rubber element 14 on a printed circuit board first, followed by compressing piston 12 where the lip 25 supporting ring 122 at the base of compressing piston 12 is seated on the support member 141. First top opening 18 and second top openings 19 of the housing 13 fit over main vertical guider 121 and the guiding arms 124 respectively, when housing 13 is positioned over compressing piston 12. Finally the connector 16 of the button 11 is inserted into the channel of the main vertical guider 121 to complete the whole assembly process.

As shown in FIG. 2, the contact position of the support member 141 and the compressing piston 12 at lip 125 of supporting ring 122 is not at the central position of the housing 13, but at either side of the interior within housing 13. When the button 11 is depressed, its displacement will not be affected by the rubber element 14. A maximum displacement can be achieved. Furthermore, since the support member 141 is closer to the internal wall of the housing 13, its span is larger and results in a more steady displacement without tilting the keyswitch.

We claim:

1. A keyswitch assembly for providing maximum displacement in a substantially vertical direction without tilting, said assembly comprising:

a housing adapted to be positioned on a membrane switch, said housing having a base opening and on a face opposite said base opening, a first top opening located at a central position of said face and a pair of second top openings, one on each side of said first opening;

a button, said button having a connector located approximately at a central position and oriented perpendicular to said button;

a compressing piston, said compressing piston further comprising:

a main vertical guider having a substantially cylindrical shape and including a guiding track, said guiding track being aligned along the cylinder axis of said vertical guider for receiving the connector of said button;

a supporting ring having an annular lip, said supporting ring being oriented concentrically with said main vertical guider and connected to said main vertical guider through a pair of radially directed rib elements, and further said supporting ring having a pair of guiding arms extending from said annular lip and aligned parallel to said main vertical guider; and said compressing piston being positioned between said housing and said membrane switch so that said main vertical guider and said pair of guiding arms pass through the face of said housing at said first top opening and pair of second top openings, respectively; and an elastic member adapted to be positioned inside of said housing and on said membrane switch, said elastic member defining:

a bottom opening having a size intermediate between the base opening of said housing and the diameter of said support ring; and a support opening on a face of said elastic member opposite to said bottom opening, said support opening comprising a support member which is dimensioned to engage the annular lip of said supporting ring, said elastic member supplying a restoring force to said compressing piston after said piston has been vertically displaced.

* * * * *